US007753024B2

(12) United States Patent
Hausler et al.

(10) Patent No.: US 7,753,024 B2
(45) Date of Patent: Jul. 13, 2010

(54) OIL SUPPLY FOR AN INTERNAL COMBUSTION ENGINE

(75) Inventors: Wolfgang Hausler, Munich (DE); Otto W. Stenzel, Neuhutten/Wustenrot (DE); Georg Sick, Feldafing (DE)

(73) Assignee: Wacker Neuson SE, Munich (DE)

( * ) Notice: Subject to any disclaimer, the term of this patent is extended or adjusted under 35 U.S.C. 154(b) by 261 days.

(21) Appl. No.: 11/568,134

(22) PCT Filed: Apr. 20, 2005

(86) PCT No.: PCT/EP2005/004245

§ 371 (c)(1),
(2), (4) Date: Jun. 13, 2007

(87) PCT Pub. No.: WO2005/103456

PCT Pub. Date: Nov. 3, 2005

(65) Prior Publication Data

US 2008/0035101 A1 Feb. 14, 2008

(30) Foreign Application Priority Data

Apr. 22, 2004 (DE) ..... 10 2004 019 630

(51) Int. Cl.
*F01M 3/04* (2006.01)
*F01M 9/08* (2006.01)
*F01M 11/02* (2006.01)

(52) U.S. Cl. ..... 123/196 R; 123/196 M; 123/41.35

(58) Field of Classification Search ..... 123/196 R, 123/196 CP, 196 M, 41.35, 193.6, 73 PP
See application file for complete search history.

(56) References Cited

U.S. PATENT DOCUMENTS

| | | | | | |
|---|---|---|---|---|---|
| 2,959,164 | A | * | 11/1960 | Janeway et al. | 123/73 A |
| 4,010,718 | A | * | 3/1977 | Stewart | 123/41.35 |
| 4,869,211 | A | * | 9/1989 | Heberle et al. | 123/41.35 |
| 5,065,707 | A | * | 11/1991 | Elsbett et al. | 123/41.42 |
| 5,092,292 | A | | 3/1992 | Iguchi et al. | |
| 5,709,185 | A | * | 1/1998 | Aizawa et al. | 123/196 R |
| 5,730,090 | A | | 3/1998 | Kling et al. | |
| 5,881,684 | A | * | 3/1999 | Bontaz | 123/41.35 |

(Continued)

FOREIGN PATENT DOCUMENTS

DE 198 34 138 C1 11/1999

(Continued)

*Primary Examiner*—Hai H Huynh
(74) *Attorney, Agent, or Firm*—Boyle Fredrickson, S.C.

(57) ABSTRACT

The invention relates to an oil supply for an internal combustion engine, comprising an oil supply device for the supply of oil to a piston, reciprocating in a cylinder. The oil supply device is embodied such that at least at a point at which the piston is in the region of bottom dead centre, oil is introduced directly into a region below the piston, by means of the oil supply device, in particular, beneath the piston crown and within the piston skirt. The oil supply device thus comprises at least one tube element, extending into a region beneath the piston crown. The tube element terminates as close as possible to a gudgeon pin, when the piston is at bottom dead center. A targeted lubrication of the mechanically and thermally highly loaded gudgeon pin can thus be guaranteed. It is also possible by means of the oil supply to supply transfer ports of a two-stroke engine with oil, counteracting a tendency to coke up.

28 Claims, 1 Drawing Sheet

U.S. PATENT DOCUMENTS

| | | | | | |
|---|---|---|---|---|---|
| 5,896,656 | A * | 4/1999 | Laws | 29/888.011 |
| 5,950,588 | A * | 9/1999 | Kusche et al. | 123/196 R |
| 5,960,764 | A * | 10/1999 | Araki | 123/196 R |
| 6,138,634 | A * | 10/2000 | Kusche et al. | 123/196 R |
| 6,250,275 | B1 * | 6/2001 | Bock et al. | 123/196 R |
| 6,298,810 | B1 * | 10/2001 | Chimonides et al. | 123/41.35 |
| 6,494,170 | B2 * | 12/2002 | Moloney et al. | 123/41.35 |
| 6,659,051 | B2 * | 12/2003 | Shiomi et al. | 123/41.42 |
| 6,845,744 | B2 * | 1/2005 | Haman | 123/196 R |
| 7,063,049 | B2 * | 6/2006 | Kemp et al. | 123/41.35 |
| 7,156,056 | B2 | 1/2007 | Lemke et al. | |
| 7,201,118 | B2 * | 4/2007 | Lenz et al. | 123/41.35 |
| 7,207,321 | B2 * | 4/2007 | Vadimovitch et al. | 123/527 |
| 2007/0245892 | A1 | 10/2007 | Lemke et al. | |

FOREIGN PATENT DOCUMENTS

| | | | |
|---|---|---|---|
| DE | 199 27 931 | A1 | 1/2001 |
| EP | 747591 | A1 | 12/1996 |
| EP | 1 070 836 | A2 | 1/2001 |

* cited by examiner

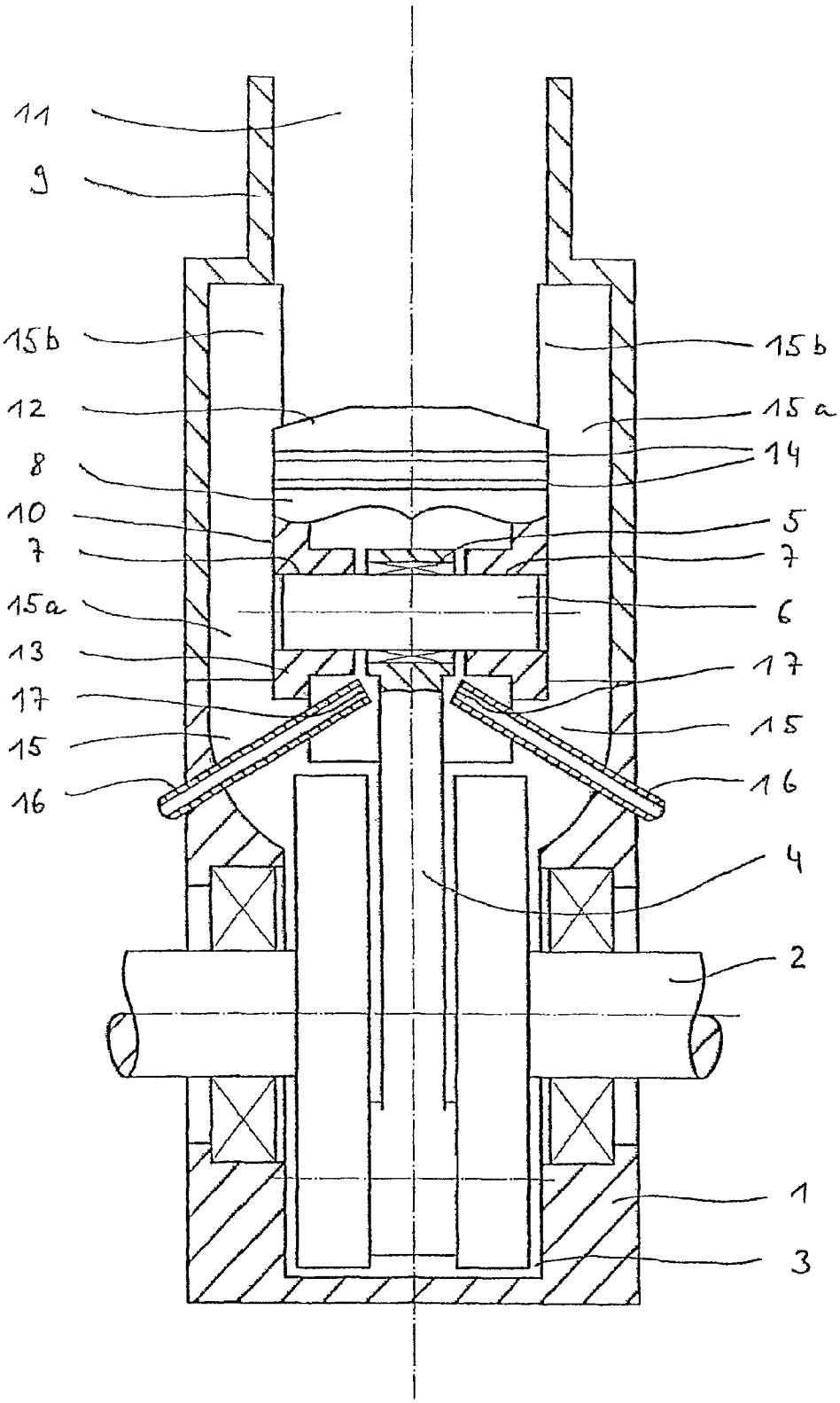
Fig.

OIL SUPPLY FOR AN INTERNAL COMBUSTION ENGINE

BACKGROUND OF THE INVENTION

1. Field of the Invention

The present invention relates to an oil supply for an internal combustion engine as recited in the preamble of patent claim 1, as well as to an oil supply for a two-stroke engine as recited in the preamble of claim 12.

2. Description of the Related Art

Such an oil supply is known from DE 42 43 571 A1. According to this document, in an internal combustion engine a piston can execute back-and-forth movement in a cylinder, and oil can be sprayed against the piston via a nozzle. When the piston is situated in the area of its lower dead center, the oil is sprayed from the nozzle against the contact surface of the piston, and is distributed via grooves that run there on the periphery of the piston. When the piston is situated in the area of its upper dead center, the oil can be sprayed from the nozzle against the lower side of the piston, i.e. the piston base, in order to cool it. When there is a low load on the engine, or the engine is still cool, the nozzle does not spray a stream of oil if the nozzle is exposed, i.e., if the piston is not situated directly in front of the nozzle. The base of the piston is cooled by the oil spray only after the engine has warmed up, and this increases when load is placed on the engine.

From EP 0 609 866 A1, it is also known to directly lubricate the piston contact surface with oil during operation of the internal combustion engine.

From DE 100 45 725 A1, a lean lubrication system for a two-stroke engine is known in which the lubricating oil is likewise dispensed only in the area of a contact surface between the piston and the cylinder, the oil being dispensable in the form of an oil aerosol.

From DE 199 27 931 A1, an internal combustion engine is known having a piston made up of a piston base and a piston skirt. On the underside of the piston base, a cooling pan is attached, forming together with the piston a cooling chamber. Via a supply opening, oil can be brought into the cooling chamber, and can be let out again via a draw-off opening. For this purpose, in the lower dead center standing pipes are coupled to the cooling pan. A similar system is known from DE 198 34 138 C1.

OBJECT OF THE INVENTION

The present invention is based on the object of further improving the oil supply for an internal combustion engine in order on the one hand to ensure a reliable functioning of the internal combustion engine through sufficient lubrication, and on the other hand to minimize the oil requirement.

The solution of this problem according to the present invention is indicated in patent claim 1. Advantageous further developments of the present invention are defined in the dependent claims. Another advantageous solution according to the present invention is indicated in Claim 13.

According to the present invention, the oil supply has an oil supply device for supplying oil to the piston, fashioned in such a way that at least at a point in time at which the piston is situated in the area of its lower dead center, the oil supply device is able to dispense oil directly into an area below the base of the piston and inside the piston skirt.

It has turned out that a piston bolt that connects the piston to a connecting rod, as well as the bearings of this bolt in the piston and in the connecting rod, are subjected to particularly high loading during operation of the internal combustion engine. While most of the bearings of the engine can be permanently lubricated, the bearing of the piston bolt cannot easily be realized as a permanently lubricated bearing due to its high thermal and mechanical loading. It is therefore very advantageous if the oil supply device dispenses the oil as close as possible to the piston bolt, which is best accessible from below, i.e., from the rear side of the piston base, facing away from the combustion chamber.

It is particularly advantageous if the oil can be supplied in liquid form, and largely without pressure. That is, in order to avoid using unnecessary quantities of oil, pressure should not be used to deliver the oil and spray it against the piston. Rather, a solution is to be sought in which the oil supply device causes oil droplets to form in the vicinity of the lower dead center of the piston, these droplets being detached during the further movement of the piston, e.g. by the air movement in the crank chamber. In this way, the formation of an oil aerosol can be avoided, in which the oil would be carried out of the crank chamber, e.g. through overflow ducts of a two-stroke engine, without having contributed to lubrication. In contrast, the compact oil droplets can strike the piston during the further movement of the piston, and in this way can be used in a targeted fashion to lubricate the piston bolt and its bearing, as well as a piston contact surface.

In a particularly advantageous specific embodiment of the present invention, the oil supply device has at least one pipe element that extends from a cylinder wall or from a crank chamber wall connected to the cylinder wall into a region underneath the piston base, the oil being able to be supplied through the inside of the pipe element.

With the aid of the pipe element, it is particularly simple to bring the oil as close as possible to the underside of the piston, or piston base. Because the oil is conveyed to an outlet opening of the pipe extending into the crank chamber under only a slight conveying pressure, the oil is not sprayed. The oil merely pours out of the outlet opening, without its surface tension being overcome by the outflow speed. The oil drops that form in this way at the outlet opening are detached from the end of the pipe element by the air movement in the crank chamber. Formation of an aerosol due to a high outflow speed at the outlet opening of the pipe element, or due to the mixture of pressurized air and oil, can be effectively avoided. A nozzle that may be placed on the outlet opening of the pipe element should therefore be designed in such a way that the oil is not sprayed by it.

In a particularly advantageous further development of the present invention, the length of the pipe element is dimensioned such that when the piston reaches its lower dead center it just misses touching the outlet opening of the pipe element. Ideally, the pipe element extends into an area situated just below or even inside the piston skirt. In this way, the oil can be guided into the area of the piston bolt in a targeted fashion without being unnecessarily distributed in the crank chamber along the way. The oil drops are conveyed via one or more pipe elements and are detached in the crank housing by the air stream that prevails there, and are first conducted to the piston bolt in order to lubricate this highly loaded joint. After this, the oil is distributed from here through a piston bolt bore in the piston, or, due to the play between the piston bolt and its bearing points, onto the contact surface between the piston and the cylinder.

Here it is also possible, if the oil flowing from the outlet opening of the pipe element forms a drop in which a part of the piston, e.g. a part of a piston wall element or of a connecting rod element, is immersed, causing the oil to be either directly transferred to these movable components or to be thrown in targeted fashion onto a desired point by displacing action of the immersed element (e.g. a tip).

In order to support the droplet formation, in a preferred development of the present invention the pipe element is oriented upward relative to a normal operating position of the internal combustion engine, so that the oil is able to collect on the upper side of the pipe element and can be drawn off upward.

The oil supply device can have an oil pump that is able to be controlled dependent on the rotational speed or load state of the internal combustion engine.

Here it is particularly advantageous if the oil pump conveys the oil only at the times at which the piston is situated in the area of its lower dead center. For this purpose, the oil pump can be constructed such that it conveys the quantity of oil required for an oil drop at each of the desired times. It is also possible for the oil pump to convey the oil intermittently, with a pulse predetermined by the stroke movement of the piston, in order to produce the oil drops in pulsed fashion; here an oil supply pulse should comprise a plurality of working strokes of the engine (stroke movements).

Because, as stated above, the oil supplying in the internal combustion engine should be limited to the area directly underneath the piston, in particular to the piston bolt, in another specific embodiment of the present invention it is particularly advantageous that the piston has a piston contact surface that is equipped with an emergency running layer and/or with an oil depot layer. This means that it is not absolutely necessary to constantly supply the piston contact surface, and thus the contact surface between the piston and the cylinder, with oil. Rather, the depots on the piston contact surface used for long-term lubrication are sufficient to ensure adequate lubrication over a sufficiently long period of time without a permanent oil supplying.

In a particularly advantageous specific embodiment of the present invention, the oil supply is fashioned specifically for a two-stroke engine, the pipe element penetrating a wall of the crank chamber in the vicinity of an inlet opening of at least one overflow duct. The provision of overflow ducts in two-stroke engines is known, and is required for them to perform their function. The overflow ducts are used to conduct an air-fuel mixture or the combustion air in direct injectors from the crank chamber into a combustion chamber. Because many different kinds of overflow ducts have been described, a more detailed description is not required here.

In the advantageous specific embodiment, the pipe element protrudes upwards into the crank chamber in such a way that at least a part of the oil that is conveyed through the interior of the pipe element in the direction of the crank bolt flows on the outside of the pipe element back to the inlet opening of the overflow duct, after exiting at the outlet opening of the pipe element. From there, the oil can either be carried along by the prevailing flow of the air-fuel mixture in the overflow duct as a wall film in order to wet the walls of the overflow duct, and/or can be distributed directly onto the walls of the overflow duct.

In two-stroke engines, it has turned out that when there is very low oil lubrication, in particular if the air-fuel mixture flowing through the crank chamber does not carry any oil droplets along with it, there is a danger of carbonization in the overflow ducts. In cases of such minimal lubrication in two-stroke engines, it has been observed that in the area close to the combustion chamber the overflow ducts become filled with coked gasoline residue, which has a significant adverse effect on the functioning and reliability of the engine, and can cause a total failure. It is also been observed that the coking tendency can be counteracted by wetting the surfaces of the overflow ducts with oil, which can be ensured by the above-described guiding back of a part of the oil from the pipe element.

Alternatively, in a coordinate aspect of the present invention, in an oil supply for a two-stroke engine it is possible to use the oil supply device to dispense the oil into an area of an inlet opening of the overflow duct, or into the overflow duct itself, in a targeted manner. A supplying of oil to other areas of the two-stroke engine is not required.

With such an oil supply, it is possible to permanently lubricate all movable parts of the two-stroke engine, including the crankshaft bearing and connecting rod bearing, the piston bolt bearing, or the contact surface between the piston and the cylinder, so that no oil lubrication is required for these parts.

However, in order to avoid the risk of coking of the overflow ducts, a supply of oil to the overflow ducts must be ensured. The oil can be dispensed at the inlet opening of the overflow duct, and can be carried along essentially as a wall film by the air stream in the overflow duct. Alternatively, the oil can also be dispensed directly into the overflow duct itself, e.g. with the aid of a suitable pipe element or by an oil outlet opening in a wall of the overflow duct; here it would be particularly advantageous to dispense the oil at the end of the overflow duct near the combustion chamber.

In supplying the overflow ducts with oil in this way, it is possible to provide a two-stroke engine that does not otherwise require any additional oil lubrication.

These and additional advantages and features of the present invention are explained in more detail in the following on the basis of an exemplary embodiment, with the aid of the accompanying FIGURE.

BRIEF DESCRIPTION OF THE DRAWINGS

The single FIGURE schematically shows a section through a two-stroke engine. However, the present invention is also suitable for other types of combustion engines, in particular also for a four-stroke engine that does not have an oil sump.

DETAILED DESCRIPTION OF THE PREFERRED EMBODIMENT

In an engine housing 1, a crankshaft 2 is mounted so as to be capable of rotation in a known manner. Crankshaft 2 passes through a crank chamber 3 provided in engine housing 1; a connecting rod 4, held on crankshaft 2 via a connecting rod bearing (not shown), also moves in this chamber in a known manner.

The end of connecting rod 4 situated opposite the connecting rod bearing supports, via an additional connecting rod bearing 5, a piston bolt 6. Piston bolt 6 passes on both sides through a respective piston bolt bore 7 formed in a piston 8. Piston 8 is capable of back-and-forth movement in a cylinder 9, and between piston 8 and cylinder 9 there exists a contact surface over which there is provided a piston contact surface 10 fashioned as a cylindrical jacket surface of piston 8.

Above piston 8, in cylinder 9 a combustion chamber 11 is present that is not shown in more detail in the FIGURE.

Piston 8 is essentially made of a piston base 12, which has a disk-shaped design and directly adjoins combustion chamber 11. Going out from piston base 12, there extends, likewise as a component of piston 8, a piston skirt 13, which is designed in the shape of a cylinder sleeve and which can also be designated a piston shaft. In piston skirt 13, piston bolt bores 7 are formed, and piston bolt 6 is mounted.

In piston skirt 13 or piston base 12, on the outer periphery, i.e., in piston contact surface 10, grooves 14 are additionally fashioned in which piston rings (not shown), e.g. wedge-type rings, are placed in a known manner. To this extent, piston 8 has a known design. However, piston contact surface 10 should be advantageously equipped with an emergency running layer and/or an oil depot layer, in order to minimize the oil lubrication requirement for piston contact surface 10.

In one wall of crank chamber 3, inlet openings 15 for overflow ducts 15*a* are formed that in turn open into outlet cross-sections 15*b*. When there is a backward movement of piston 8, the air-fuel mixture in crank chamber 3 is impelled out of crank chamber 3 and is conveyed through overflow duct 15*a* (or through a plurality of overflow ducts 15*a*) to combustion chamber 11, where, in the following power stroke, the air-fuel mixture is ignited after renewed compression by piston 8. This working principle of a two-stroke engine has long been known, so that further explanation, in particular of the design of overflow ducts 15*a*, is not required here.

The depicted two-stroke engine is equipped with an oil supply according to the present invention, which has, inter alia, an oil supply device for supplying oil to piston 8.

The oil supply device has two pipe elements 16 that are connected at the input side with an oil pump (not shown).

The oil or dosing pump can be fashioned as a continuous pump (e.g. a gear pump) or as a pump that operates in a discontinuous manner (e.g. a piston pump, membrane pump, piezo pump, or bubble-jet pump). It should convey the oil to a respective outlet opening 17 of pipe element 16 with only a slight conveying pressure. A spraying pressure should not be produced, that the oil flows out of outlet opening 17 without its surface tension being overcome by the outflow speed and, as a result, the oil is dispensed in a non-spray form. The oil drops that exit in this manner are detached by the movement of the air in crank chamber 3, in particular due to the movement of piston 8, so that the drops impact against connecting rod 4 or against piston bolt 6 as piston 8 continues to move. From there, the oil is distributed e.g. onto connecting rod bearing 5 or into piston bolt bores 7, and can finally reach the outside of piston 8, i.e., piston contact surface 10.

An aerosol formation of the oil due to high outflow speeds at outlet opening 17, in particular at a nozzle placed there, or due to the mixture of pressurized air with the oil, should be avoided, in order to ensure a concentrated supply of oil to the underside of piston base 12, or into the interior of piston skirt 13. In contrast, an oil aerosol would also reach points in crank chamber 3 that do not require any lubrication.

Pipe elements 16 extend from below into the area underneath piston 8; they should extend far enough that they approach piston bolt 6 as closely as possible when piston 8 is situated at its lower dead center (shown in the FIGURE). It is particularly advantageous if pipe elements 16 even extend into the interior of piston skirt 13.

Outlet openings 17 terminate next to the connecting rod bar of connecting rod 4, approximately centrically relative to connecting rod bearing 5. In order to avoid unnecessary oil losses in overflow ducts 15*a*, it is advantageous for the ends of pipe elements 16 to terminate as high as possible. This means that at the lower dead center of piston 8, pipe elements 16 extend as high as possible under piston skirt 13.

A portion of the oil that exits at outlet opening 17 is not carried along by piston 8, but rather flows on the outside of pipe elements 16 back to inlet openings 15, and thus moves into overflow ducts 15*a*. From there, the oil can be drawn further into overflow ducts 15*a* by the flow of the fuel-air mixture, and can also reach the area close to the combustion chamber of the respective overflow duct 15*a* at its other end, at outlet cross-section 15*b*. In this way, coking of overflow ducts 15*a* can be effectively prevented. The oil should be transported as an oil film coating on the wall. Here the directed air stream in overflow duct 15*a* acts as the driving agent.

Alternatively, in a specific embodiment of the present invention that is not depicted, it is possible to conduct the oil directly into overflow ducts 15*a*. This oil supplying into overflow ducts 15*a* can take place in addition to the oil supply to piston 8, e.g. by means of additional pipe elements 16. The quantity of oil introduced into overflow ducts 15*a* is subsequently distributed in the cylinder contact surface, and thus acts to lubricate the frictional pairing: piston, piston rings, cylinder.

In yet another specific embodiment, it is possible to introduce the oil exclusively into overflow ducts 15*a*, and to fashion connecting rod bearing 5 and piston bolt bore 7 in such a way as to ensure a permanent lubrication, so that no permanent oil supply need take place. Known carbon bushings and bolts are for example suitable for this purpose. Of course, in this case all other bearing points in the engine should be permanently lubricated that enable permanent operation without additional oil lubrication. Supplying of oil to piston 8 is then not required.

Practical trials have shown that with such a lubrication design a minimal lubrication is possible, the ratio of the quantity of oil consumed to the quantity of gasoline consumed being less than 1/200, and in particular even less than 1/600. With an oil-gasoline ratio of 1/600, long-term operation of the engine (here a two-stroke engine) is possible.

However, the required quantity of oil does not stand in a fixed ratio to the quantity of gasoline. The quantity of oil dispensed can, as has long been known, be dependent on the rotational speed, or can be provided in accordance with the indications in a set of characteristic curves. In full-load operation, a higher quantity of oil is required than in partial load or no-load operation. In no-load operation in particular, it may be possible that no oil at all need be supplied.

The controlling of the pump, and, if necessary, an associated set of characteristic curves, can be stored in a processor control unit that is advantageously integrated in an ignition or power supply module of the engine.

The invention claimed is:

1. An oil supply for an internal combustion engine, the internal combustion engine having at least one cylinder and a piston that moves back and forth in the cylinder, having a piston base and a piston skirt connected to the piston base, the oil supply device supplying oil to the piston, wherein the oil supply device is fashioned in such a way that, at least at a point in time at which the piston is situated in the area of its lower dead center, oil is dispensed in a non-spray liquid drop form by the oil supply device directly into an area underneath the piston base and inside the piston skirt.

2. The oil supply as recited in claim 1, wherein the oil is supplied largely without pressure.

3. The oil supply as recited in claim 1, wherein the oil supply device has at least one pipe element that extends from a cylinder wall, or from a crank chamber wall connected to the cylinder wall, into an area underneath the piston base, the oil being supplied through the interior of the pipe element.

4. The oil supply as recited in claim 3, wherein the length of the pipe element is dimensioned in such a way that, when the piston reaches its lower dead center, it just misses touching an outlet opening of the pipe element.

5. The oil supply as recited in claim 3, wherein the length of the pipe element is dimensioned such that an oil drop exiting at an outlet opening of the pipe element is just touched by a part of the piston.

6. The oil supply as recited in claim 3, wherein the pipe element extends into an area situated directly underneath or inside the piston skirt when the piston is situated in its lower dead center position.

7. The oil supply as recited in claim 3, wherein, when the piston is situated in its lower dead center position, the pipe element terminates in an area close to a piston bolt that connects the piston to a connecting rod.

8. The oil supply as recited in claim 3, wherein, relative to a normal operating position of the internal combustion engine, the pipe element is oriented upwards, and the oil exits upward.

9. The oil supply as recited in claim 3, wherein the internal combustion engine is a two-stroke engine, the pipe element penetrates the crank chamber wall in an inlet opening of an overflow duct, the pipe element extends upward into the crank chamber in such a way that at least a portion of the oil that is conveyed through the interior of the pipe element flows on the outside of the pipe element back to the inlet opening of the overflow duct after exiting at an outlet opening of the pipe element.

10. The oil supply as recited in claim 1, wherein the oil supply device has an oil pump that is controlled dependent on the rotational speed or load state of the internal combustion engine.

11. The oil supply as recited in claim 1, wherein the oil supply has an oil pump that conveys the oil only at those times at which the piston is situated in the area of its lower dead center.

12. The oil supply as recited in claim 1, wherein at least one of the piston and the cylinder has a contact surface equipped with an emergency running layer and an oil depot layer.

13. The oil supply as recited in claim 1, wherein the piston skirt extends axially from a perimeter of the piston base and the oil supply device further comprises a tube conveying the oil the tube having an end that, when the piston is in a bottom dead center position, is located above a bottom edge of the piston skirt and radially inside of the piston skirt such that the oil is dispensed inside of the piston.

14. An oil supply device supplying oil to a two-stroke engine, the two-stroke engine having at least one cylinder and a piston that moves back and forth in the cylinder, as well as at least one overflow duct for conducting combustion air or an air-fuel mixture from a crank chamber to a combustion chamber, wherein, through the oil supply device, oil can be dispensed in a targeted manner into an area of an inlet opening of the overflow duct, or into the overflow duct itself.

15. The oil supply device recited in claim 14, further comprising a tube extending through the at least one overflow duct toward the piston, the tube having an end that is located in a cavity that extends axially into a bottom portion of the piston when the piston is in a bottom dead center position, and wherein at least some oil runs out of the end of the tube and down an outer surface of the tube, depositing in the at least one overflow duct.

16. An internal combustion engine comprising:

at least one cylinder;

a piston that moves back and forth in the cylinder, the piston having a piston base and a piston skirt connected to the piston base; and an oil supply device for supplying oil to the piston, wherein the oil supply device is fashioned in such a way that, at least at a point in time at which the piston is situated in the area of a lower dead center position thereof, oil is dispensed in a non-spray liquid drop form by the oil supply device directly into an area underneath the piston base and inside the piston skirt.

17. The engine as recited in claim 16, wherein the oil supply device has at least one pipe element that extends from one of a cylinder wall and a crank chamber wall connected to the cylinder wall into an area underneath the piston base, the oil being supplied through the interior of the pipe element.

18. The engine as recited in claim 17, wherein the internal combustion engine is a two-stroke engine having a crank chamber, the pipe element penetrates the crank chamber wall in an inlet opening of an overflow duct, the pipe element extends upward into the crank chamber in such a way that at least a portion of the oil that is conveyed through the interior of the pipe element flows on the outside of the pipe element back to the inlet opening of the overflow duct after exiting at an outlet opening of the pipe element.

19. The engine as recited in claim 16, wherein the oil supply device has an oil pump that is controlled dependent on the rotational speed or load state of the internal combustion engine.

20. The engine as recited in claim 16, wherein the oil supply device has an oil pump that conveys the oil only at those times at which the piston is situated in the area of its lower dead center thereof.

21. The engine as recited in claim 16, wherein at least one of the piston and the cylinder has a contact surface equipped with an emergency running layer and an oil depot layer.

22. The internal combustion engine as recited in claim 16, the oil supply device further comprising a tube conveying the oil toward the piston, the tube having an end that is located (i) inside of an outer perimeter of the piston, and (ii) above a bottom edge of the piston, when the piston is in a lower dead center position.

23. A method of operating an internal combustion engine, comprising:

causing a piston to move back and forth in a cylinder between a lower dead center position and a top dead center position, the piston having a piston base and a piston skirt connected to the piston base; and supplying oil to the piston via an oil supply device, wherein, during at least at a point in time at which the piston is situated in the area of the lower dead center position thereof, oil flows out of an outlet opening of the oil supply device without the surface tension of the oil being overcome by the outflow speed of the oil and is dispensed directly into an area underneath the piston base and inside the piston skirt in liquid drop form without producing a spray.

24. The method as recited in claim 23, further comprising directing oil through a tube that extends into a void space defined within the piston.

25. A two-stroke internal combustion engine comprising:

a housing defining a crank chamber therein;

a cylinder extending away from the crank chamber;

a combustion chamber connected to an end of the cylinder;

an overflow duct provided outside of the cylinder and connecting the crank chamber and combustion chamber to each other;

a piston that moves back and forth in the cylinder, the piston having a piston base and a piston skirt connected to the piston base; and an oil supply device dispensing oil in a non-spray liquid drop form, the oil supply device having an outlet opening that is adjacent a piston bolt that attaches the piston to a connecting rod and thus directly dispenses oil onto the piston bolt.

26. The engine as recited in claim 25, wherein the oil, being oil in a non-spray liquid drop form, that is dispensed by the oil supply device is first conducted to and lubricates the piston bolt.

27. A two-stroke internal combustion engine comprising:

a housing defining a crank chamber therein;

a cylinder extending away from the crank chamber;

a combustion chamber connected to an end of the cylinder;

an overflow duct provided outside of the cylinder and connecting the crank chamber and combustion chamber to each other;

a piston that moves back and forth in the cylinder, the piston having, a piston base defining an outer periphery; and a piston skirt connected to and extending downwardly from the outer periphery of the piston base such that a void space is defined between the piston base and piston skirt;

a piston bolt connecting the piston to a connecting rod such that an interface is defined between respective facing surfaces of the piston base, the piston bolt, and the connecting rod; and an oil supply device dispensing oil in a non-spray liquid drop form, the oil supply device having a pump conveying oil at a low pressure; and a tube having an end that is located within the void space between the piston base and piston skirt, the tube having an outlet opening that is adjacent a piston bolt that attaches the piston to a connecting rod such that the interface between the piston base, piston bolt, and connecting rod, is directly lubricated by oil exiting the outlet opening of the tube.

28. A two-stroke internal combustion engine comprising:

a housing defining a crank chamber therein;

a cylinder extending away from the crank chamber;

a combustion chamber connected to an end of the cylinder;

an overflow duct provided outside of the cylinder and connecting the crank chamber and combustion chamber to each other;

a piston that moves back and forth in the cylinder, the piston having a piston base and a piston skirt connected to the piston base; and an oil supply device dispensing oil in a non-spray liquid drop form, the oil supply device having an outlet opening that is adjacent a piston bolt that attaches the piston to a connecting rod, and a tube that extends through a lower portion of the overflow duct and angularly toward the piston.

* * * * *